US009083115B2

(12) United States Patent
Hoppmann et al.

(10) Patent No.: US 9,083,115 B2
(45) Date of Patent: Jul. 14, 2015

(54) ELECTRICAL CONNECTION TERMINAL

(75) Inventors: Ralph Hoppmann, Bad Oeynhausen (DE); Michael Strato, Steinheim (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 19 days.

(21) Appl. No.: 14/128,005

(22) PCT Filed: Jun. 21, 2012

(86) PCT No.: PCT/EP2012/002617

§ 371 (c)(1),
(2), (4) Date: Dec. 20, 2013

(87) PCT Pub. No.: WO2012/175205

PCT Pub. Date: Dec. 27, 2012

(65) Prior Publication Data

US 2014/0127932 A1 May 8, 2014

(30) Foreign Application Priority Data

Jun. 21, 2011 (DE) ..... 10 2011 115 637

(51) Int. Cl.

| | |
|---|---|
| ***H01R 4/48*** | (2006.01) |
| ***H01R 13/627*** | (2006.01) |
| ***H01R 43/20*** | (2006.01) |
| *H01R 9/26* | (2006.01) |

(52) U.S. Cl.

CPC ..... *H01R 13/627* (2013.01); *H01R 4/4827* (2013.01); *H01R 43/20* (2013.01); *H01R 9/26* (2013.01); *Y10T 29/49208* (2015.01)

(58) Field of Classification Search

CPC .. H01R 4/2408; H01R 4/2433; H01R 4/4845; H01R 4/4818; H01R 12/515; H01R 4/4809; H01R 4/48; H01R 4/4872; H01R 24/76; H01R 9/24; H01R 9/2416

USPC ..... 439/441, 835–336, 716

See application file for complete search history.

(56) References Cited

U.S. PATENT DOCUMENTS

| | | | | |
|---|---|---|---|---|
| 5,853,304 | A * | 12/1998 | Landreau et al. | 439/721 |
| 6,146,186 | A * | 11/2000 | Barrat et al. | 439/410 |
| 7,785,134 | B2 | 8/2010 | Dhandapani et al. | |
| 8,062,079 | B2 * | 11/2011 | Hoppmann | 439/834 |
| 2006/0128206 | A1 | 6/2006 | Oesterhaus | |
| 2007/0072481 | A1 | 3/2007 | Edenharter | |

FOREIGN PATENT DOCUMENTS

| | | | |
|---|---|---|---|
| DE | 297 21 214 | U1 | 3/1999 |
| DE | 198 23 648 | C1 | 11/1999 |
| DE | 10 2004 044 889 | A1 | 3/2006 |

(Continued)

*Primary Examiner* — Xuong Chung Trans

(74) *Attorney, Agent, or Firm* — Roberts Mlotkowski Safran & Cole, P.C.; David S. Safran

(57) ABSTRACT

An electrical connection terminal having a housing, two clamping springs and a current bar, wherein a chamber is formed in the housing for receiving the clamping springs and at least one end of the current bar as well as a conductor insertion opening for inserting two conductors, and wherein the clamping springs are arranged next to each other in relation to the longitudinal extension of the current bar. In the electrical connection terminal, the clamping springs each have a clamping leg, an operating leg and a back which connects the two legs to one another, wherein the clamping limbs, together with the current bar form, in each case, a clamping point for a stripped conductor that is to be connected. Moreover, a spring receptacle is provided within the chamber, which has a partition, the two clamping springs being disposed on a respective side of the partition.

16 Claims, 6 Drawing Sheets

(56) References Cited

FOREIGN PATENT DOCUMENTS

| | | | |
|---|---|---|---|
| DE | 10 2006 057 712 | B3 | 4/2008 |
| DE | 10 2008 039 232 | A1 | 2/2010 |
| DE | 10 2009 048 932 | A1 | 10/2010 |
| EP | 1 734 551 | A1 | 12/2006 |
| WO | 01/89037 | A1 | 11/2001 |

* cited by examiner

ELECTRICAL CONNECTION TERMINAL

BACKGROUND OF THE INVENTION

1. Field of the Invention

The invention relates to an electrical connection terminal with a housing, with two clamping springs and with at least one current bar, the housing having a chamber for accommodation of the clamping springs and at least one end of the at least one current bar and at least one conductor entry opening for entry of two conductors, and the clamping springs being located next to one another relative to the longitudinal extension of the current bar. In addition, the invention also relates to a method for mounting of a corresponding electrical connection terminal.

2. Description of Related Art

Electrical connection terminals are known in a plurality of embodiments. The terminals can be made, for example, for connection to another conductor as a terminal block or for connection of an electrical conductor to a circuit board as a so-called print terminal. Moreover, electrical connection terminals can also be part of electrical devices such as, for example, miniature circuit breakers, ground fault circuit interrupters, or overvoltage breakers and can be used for connection of the conductors which are to be connected to the components which are located in the interior of the devices.

Clamping springs can be loop-shaped clamping springs, so-called tension spring terminals, and also U-shaped or V-shaped clamping springs, so-called leg springs. In leg springs, rigid conductors or conductors which are provided with a wire end ferrule can be inserted directly, i.e., without the clamping site having to be opened beforehand with a tool. Therefore these terminals are also called direct push-lock terminals. In the known loop-shaped tension springs, according to their name, the conductor which is to be connected is pulled by the clamping leg against a conductor bar. In contrast thereto, for U-shaped or V-shaped clamping springs, the conductor which is to be connected is pressed against the current bar or one region of a metal part.

German Patent Application DE 10 2008 039 232 A1 discloses an electrical connection terminal with an essentially V-shaped clamping spring and a metal part. In this connection terminal, the clamping spring acts as a compression spring which presses a conductor which is to be connected by the spring force of the clamping spring against a bent section of the metal part which acts as a current bar, and in this way, produces the electrically conductive contact between the conductor and the current bar or the metal part.

In general, in a chamber which is made in the housing of an electrical connection terminal, there are always only one clamping spring and one current bar or the end of one current bar so that only one electrical conductor for insertion into the clamping site can be inserted through the conductor entry opening. But, in addition, there are also electrical connection terminals which have a so-called double connection in which, specifically within a chamber, there are two clamping springs for connection of two conductors next to one another. In practice, these connection terminals with double connection are used, for example, as distribution terminals since they offer the possibility of a high wiring density on an extremely narrow space by the double connection (compare brochure "Terminal Blocks CLIPLINE 2005" page 153 of Phoenix Contact GmbH & Co. KG). In these known terminals, within the chamber, there are two tension spring terminals with which two electrical conductors can be connected to the same potential or for two chambers which are made in the housing, four conductors can be connected to a potential.

German Patent Application DE 10 2009 048 932 A1 discloses an electrical connection terminal as part of an installation switching device in which within a chamber two electrical conductors can be connected to a current bar. For this purpose, there is a double spring with two clamping legs within a clamping frame, the two clamping legs each have a clamping piece which is bent away from the clamping frame forming a clamping site for a stripped conductor which is to be connected. On the second narrow side of the clamping frame opposite the first narrow side with the clamping piece, moreover, a current bar is molded via which the electrical connection is established between the clamping frame and a component which is located within the installation switching device. However, the disadvantage here is that a special double spring is needed as the clamping spring. Moreover, the mounting of the clamping frame with the current bar molded on it and of the double spring which has been inserted into the clamping frame is complex.

SUMMARY OF THE INVENTION

Therefore, the object of the invention is to develop an electrical connection terminal as described initially such that it has a structure that is as simple as possible, and a connection of rigid conductors or conductors provided with a wire end ferrule is to be directly possible, i.e., without the clamping site having to be opened beforehand with a tool. Moreover, the maximum cross section of the conductor to be connected is to be independent of whether the conductor has a wire end ferrule or not.

This object is achieved in the initially described electrical connection terminal in that the clamping springs each have one clamping leg, one contact leg and an arc-shaped back which connects the two legs to one another, the clamping legs with the current bar each forming a clamping site for a stripped conductor which is to be connected. Moreover, inside the chamber there is a spring receiver which has a partition, the two clamping springs being located on a respective side of the partition.

The electrical connection terminal in accordance with the invention thus differs, first of all from the distribution terminals known from practice in that two separate leg springs with one clamping leg and one contact leg each are used as clamping springs instead of two tension spring terminals. Moreover, the two clamping springs are not seated either directly on the end of the current bar or inserted into a clamping frame. In the electrical connection terminal in accordance with the invention, there is instead an additional spring receiver which is made preferably of plastic, on which the two clamping springs are attached. The spring receiver has a partition which is located between the two clamping springs when the latter are mounted.

The spring receiver is used not only for mounting of the two clamping springs in the chamber of the housing of the electrical connection terminal, but also to ensure a defined distance between the two clamping springs. This ensures that two conductors which are intended for the electrical connection terminal with a maximum diameter can also still be connected when the two conductors have a wire end ferrule. The space between the two adjacent conductors to be connected which is required for the wire end ferrules, especially for their plastic collars, is thus ensured by the partition of the spring receiver. In contrast, in the distribution terminals known from practice with a double connection formed by two tension spring terminals, the maximum allowable conductor cross section of a flexible conductor with a wire end ferrule is smaller than the maximum allowable cross section of a rigid conductor.

It was stated initially that the electrical connection terminal has two clamping springs and at least one current bar. In this way, it is not precluded that the electrical connection terminal can also have more than two clamping springs, for example, four or eight clamping springs, especially when the electrical connection terminal is a terminal block, which generally has at least one chamber on the two connection sides. A simple feed-through terminal which has one chamber each on the two connection sides thus has a total of four clamping springs—two clamping springs in each chamber. Of course, it is also possible for there to be one chamber with the clamping springs only on one side of this feed-through terminal, while on the other side there is only one clamping spring in the chamber.

Moreover, it is also fundamentally possible for there to be not only two clamping springs within one chamber, but also the ends of two current bars so that two electrical conductors can be connected to two different potentials. Regardless, in the following description of the invention, it is always assumed that in one chamber there are two clamping springs, but only one current bar or the end of a current bar so that two conductors connected to the two clamping springs are connected to the same current bar, and thus, also to the same potential.

According to one advantageous configuration of the invention, the spring receiver on the two sides of the partition has several projections which are used to hold the clamping springs. Preferably, on the two sides of the partition, there is one projection within and two projections outside of the clamping springs at a time. The two projections which are located within the clamping springs are thus at least partially looped by a respective clamping spring, these projections being made and located on the partition such that they are used as a stop of a respective clamping leg when the clamping legs are deflected.

This projection, which protrudes vertically in the region between the two legs of one clamping spring from the partition, has one end which in the mounted state of the clamping springs is located on the spring receiver in the region of the arc-shaped back of the clamping springs so that the arc-shaped back of the clamping spring rests at least in areas on the end of the projection. The other two projections are located in the region of the clamping leg or of the contact leg such that the clamping spring is clamped between the two projections when the clamping leg and the contact leg are pressed slightly together during mounting. The clamping springs can thus be easily mounted on the spring receiver, the clamping springs being held on the spring receiver as a result of their spring force.

According to another configuration of the electrical connection terminal in accordance with the invention, the spring receiver is latched to the clamping springs in the chamber of the housing, for which, in the chamber and on the spring receiver, catch devices which correspond to one another are made. The catch devices are located in the region between the two legs of the clamping springs so that the dimensions of the spring receiver and the chamber are not increased by the catch devices. The catch devices are preferably implemented by two catch pegs which are located within the chamber and two corresponding openings which are made in the spring receiver so that the spring receiver can be easily slipped onto the catch pegs in the chamber with the openings.

In addition to the catch devices for holding and latching of the spring receiver, according to a preferred configuration of the invention, within the chamber of the housing, at least one catch element for latching of the current bar in the housing is also made, for which the current bar has a corresponding catch recess. This ensures that not only can the clamping springs be reliably fastened on the spring receiver, but that the spring receiver and the current bar are also reliably held in the housing.

Depending on the configuration of the housing or of the chamber which is made in the housing and especially depending on the configuration of the current bar, there are various possibilities for mounting of the electrical connection terminal. According to a first configuration, mounting takes place such that first the two clamping springs are located on a respective side of the partition of the spring receiver, then the spring receiver with the two clamping springs attached to it is inserted into the chamber and afterwards the current bar as a separate component is inserted into the chamber of the housing such that the clamping legs of the two clamping springs with the current bar form a respective clamping site for a stripped conductor which is to be connected.

According to an alternative mounting approach, first the spring receiver is slipped onto the current bar, for which catch devices which correspond to one another are made on the current bar and on the spring receiver. Only afterwards are the two clamping springs arranged on a respective side of the partition of the spring receiver such that the clamping legs with the current bar each form a clamping site for a conductor. Last, the pre-mounted assembly formed of the two clamping springs, the current bar and the spring receiver are inserted into the chamber of the housing.

Regardless of which of the two above described methods is provided for mounting of the electrical connection terminal, the spring receiver is preferably latched in the chamber upon insertion into the housing, for which there are two catch pegs within the chamber and two openings in the spring receiver which correspond to the catch pegs.

Both the spring receiver and also the clamping springs are preferably made such that they can be used for the above described types of mounting. Moreover, since the spring receiver is preferably made symmetrical to the middle plane which runs through the partition, for terminal blocks, the same spring receiver can be used on the two connection sides so that the number of required parts is reduced.

In particular, there are now various possibilities for configuring and developing the electrical connection terminal in accordance with the invention and the method in accordance with the invention. In this respect reference is made to the following description of two preferred exemplary embodiments in conjunction with the drawings.

DETAILED DESCRIPTION OF THE INVENTION

Figure 1:
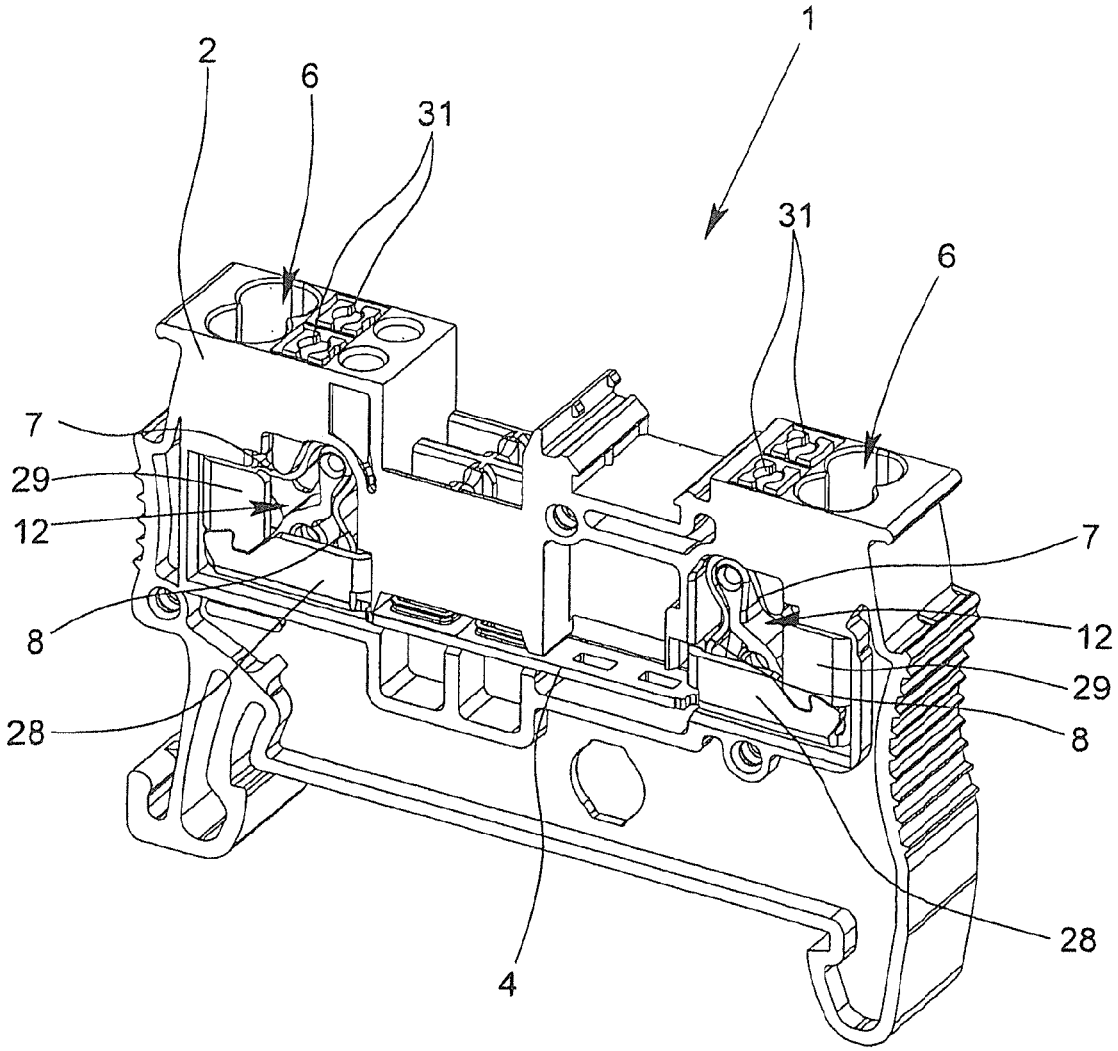
FIG. 1 is a perspective view of an electrical connection terminal in accordance with the invention which is made as a terminal block.
Figure 4:
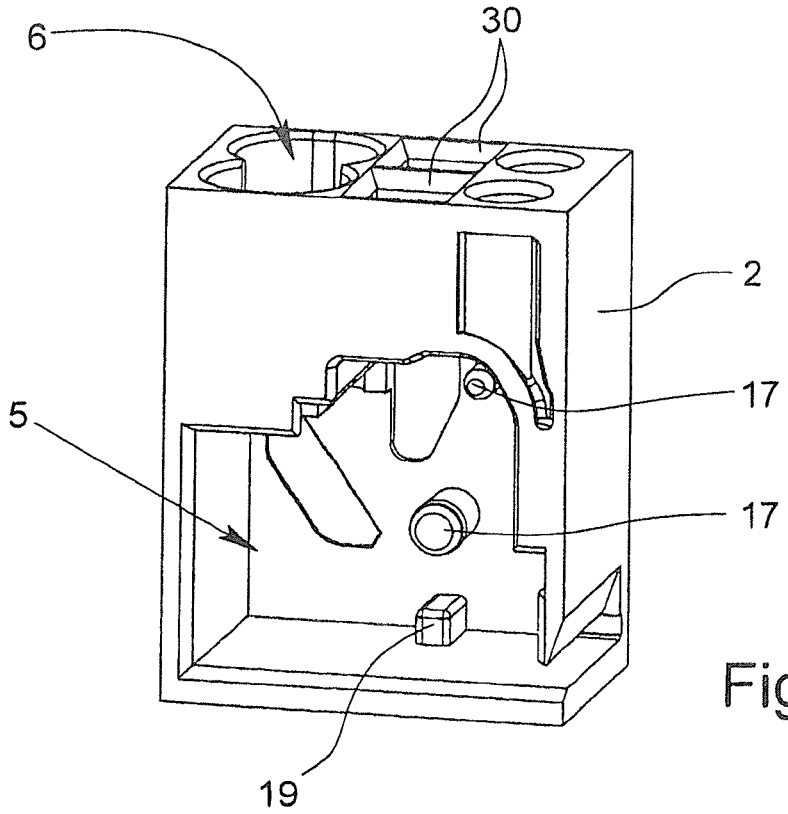
FIG. 4 shows part of the housing of an electrical connection terminal with an empty chamber.

FIG. 1 shows an electrical connection terminal 1 which is made as a terminal block. The electrical connection terminal 1 has a plastic housing 2, there being two clamping springs 3, 3' (see, FIG. 4) and one current bar 4 which connects the clamping springs 3, 3' to one another in the housing 2 on each of the two sides of the electrical connection terminal 1. To accommodate the clamping springs 3, 3' and at least the two ends of the current bar 4, two chambers 5 are made in the housing 2 of the terminal block (see, FIG. 4). The conductors to be connected can each be inserted into one chamber 5 via a conductor entry opening 6 into which two electrical conductors can be inserted. Fundamentally, instead of the illustrated "double" conductor entry opening 6 two individual conductor insertion openings can also be made next to one another, and then, only one conductor can be inserted into each conductor insertion opening. As FIG. 1 shows, the clamping springs 3, 3' which are accommodated by a chamber 5 are arranged next to one another relative to the longitudinal extension of the current bar 4.

In the illustrated electrical connection terminal, the clamping springs 3, 3' are made essentially V-shaped so that they are leg springs which each have one clamping leg 7, one contact leg 8 and an arc-shaped back 9 which connects the two legs 7, 8 to one another. The clamping springs 3, 3' together with one section of the current bar 4 form one spring force clamping connection in which the clamping legs 7 with the current bar 4 each form a clamping site for a stripped conductor which is to be connected. For easier mounting and for accurate positioning of the clamping springs 3, 3', within the chamber 5 of the housing 2 there is a spring receiver 10 which has a partition 11 whose main extension runs in the direction of extension of the current bar 4, i.e., runs in the direction of longitudinal extension of the electrical connection terminal 1 shown in FIG. 1.

Figure 2:
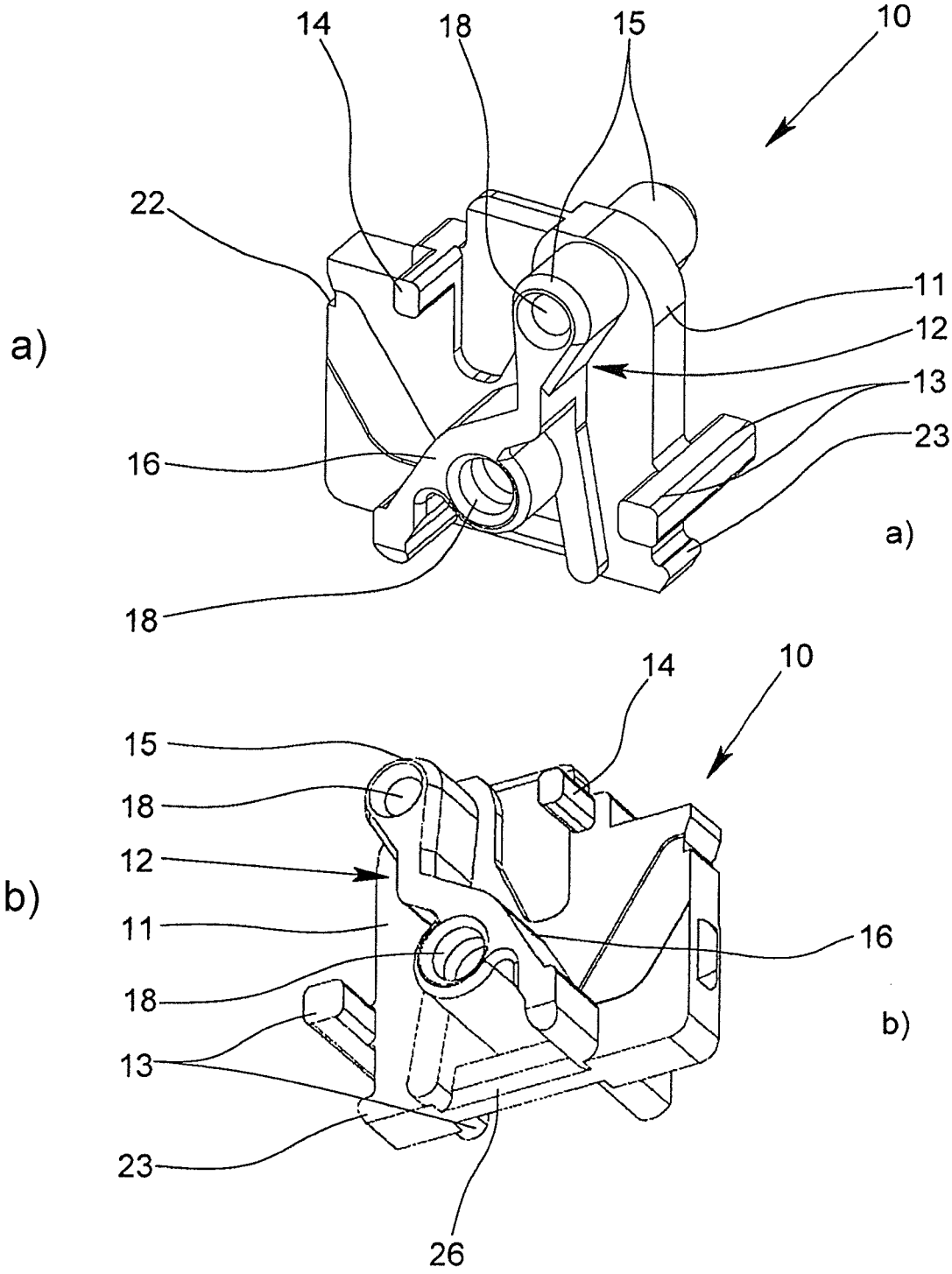
FIGS. 2*a* & 2*b* are perspectives of opposite sides of the spring receiver of the electrical connection terminal in accordance with the invention.
Figure 3:
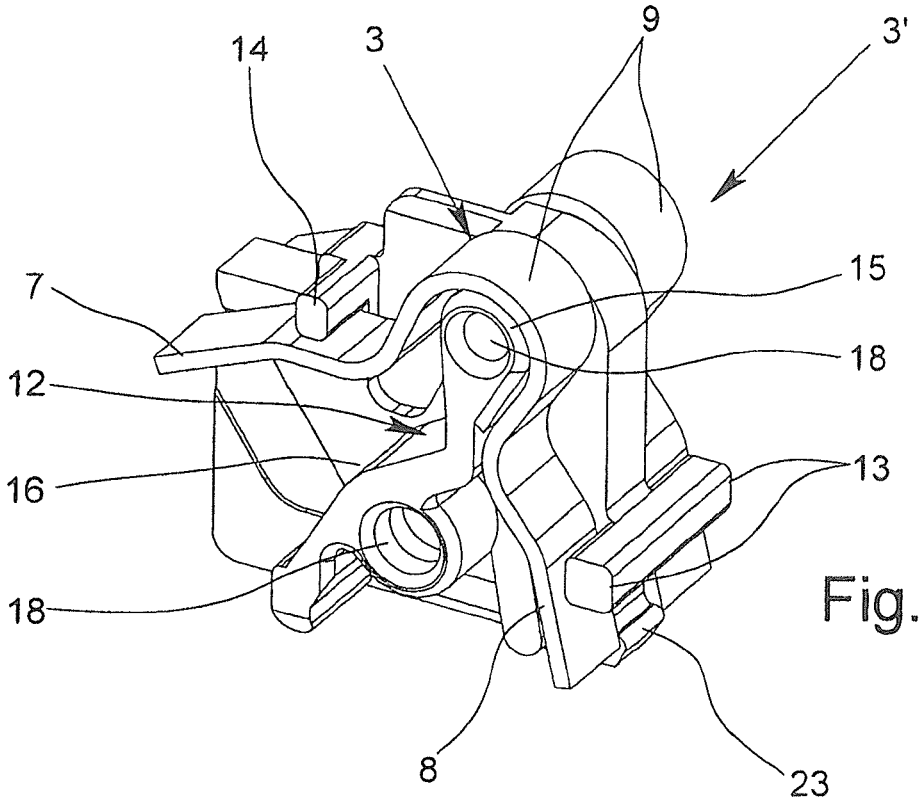
FIG. 3 is a perspective view of the spring receiver according to FIG. 2 with two mounted clamping springs.

The exact structure and configuration of the spring receiver 10 are recognizable especially in the perspectives of FIG. 2. The spring receiver 10, on each side of partition 11, has several projections 12, 13, 14 which are used to hold a respective one of the clamping springs 3, 3'. As FIG. 3 shows, the roughly rib-like projection 12 is located within the clamping springs 3, 3', i.e., between the clamping leg 7 and the contact leg 8, while the two bar-shaped projections 13, 14 are located outside the clamping springs 3, 3'. The projections 13, 14 are arranged and spaced apart from one another such that the clamping leg 7 and the contact leg 8 are deflected inward slightly out of their rest position, when a clamping spring 3, 3' is slipped onto the spring receiver 10. The clamping spring 3, 3' is thus held between the two projections 13, 14 due to its spring force.

So that the clamping spring 3 remains in its given position, one end 15 of the projection 13 is made and arranged such that the clamping spring 3, with its arc-shaped back 9, at least partially encompasses the end 15 or rests on the end 15. Also, the rib-like projection 12 has a section 16 whose contour is matched to the contour of the clamping leg 7 and which is located on the spring receiver 10 such that the section 16 of the projection 12 when the clamping leg 7 is deflected is used as a stop for the latter. The projection 12 is thus used not only for fixing the position of the clamping spring 3, but at the same time, also as protection against over-flexing of the clamping spring 3.

For reliable attachment of the spring receiver 10 with the clamping springs 3, 3' attached to it in the chamber 5 of the housing 2, in the chamber 5 has two catch pegs 17 that correspond to openings 18 of spring receiver 10 so that the openings 18 of the spring receiver 10 can be slipped onto the catch pegs 17 in the chamber 5. As is apparent from FIGS. 3 and 4, both the catch pegs 17 and also the openings 18 are arranged such that they are located between the legs 7, 8 of the clamping springs 3, 3' in the mounted state of the spring receiver 10. Due to the arrangement and execution of the catch pegs 17 and of the openings 18, the dimensions of the chamber 5 and of the spring receiver 10 do not increase. In the illustrated exemplary embodiment, the two openings 18 in the spring receiver 10 are made in the region of the projections 12 so that intentional deflection of the clamping leg 7 when an electrical conductor is connected is not hindered by the catch pegs 17.

Figure 5:
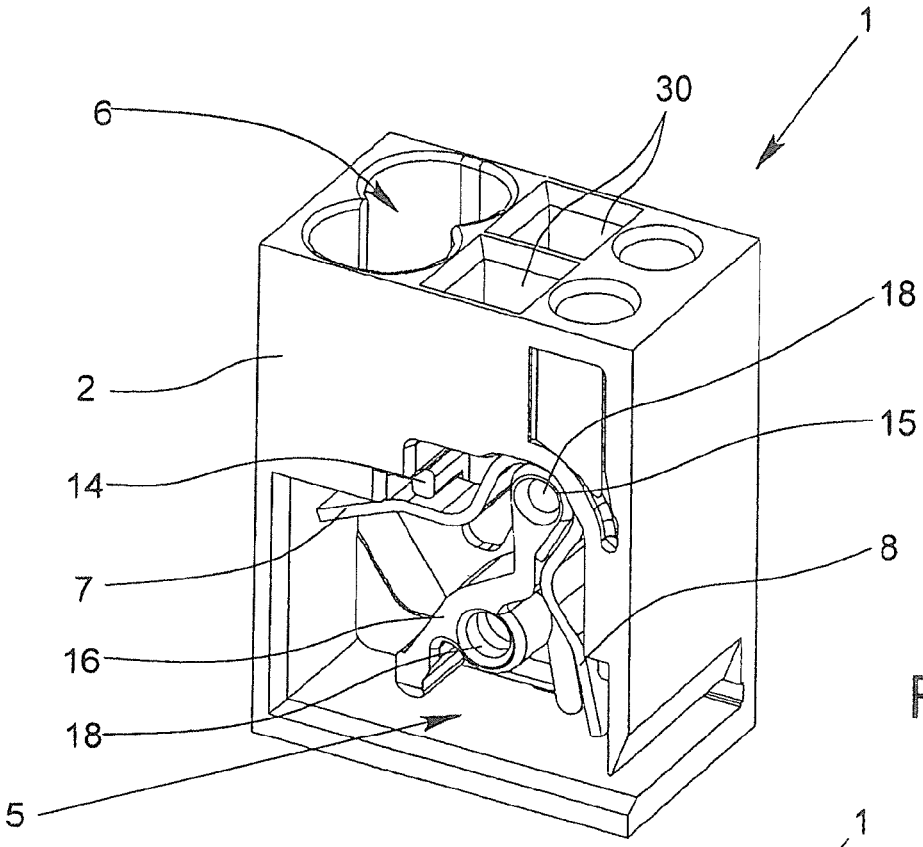
FIG. 5 is a perspective view of the housing according to FIG. 4 with a spring receiver which has been inserted into the chamber.

In the exemplary embodiment of an electrical connection terminal 1 which is shown in FIGS. 3 to 6, mounting takes place such that, first, each of the clamping springs 3, 3' is slipped onto the spring receiver 10 at a respective side of the partition 11 (FIG. 3). Then, the unit composed of the two clamping springs 3, 3' and the spring receiver 10 is inserted into the chamber 5 of the housing 2, by openings 18 of the spring receiver 10 being slipped onto the catch pegs 17 (FIG. 5). Afterwards, then, the current bar 4 is inserted into the chamber 5, the clamping legs 7 of the two clamping springs 3, 3' each forming with the current bar 4 a clamping site for a stripped conductor which is to be connected. In order to fix the current bar 4 reliably and in the given position in the chamber 5, a projection 19 is provided in the chamber 5 (FIG. 4) and a corresponding recess 20 is provided in the current bar 4 (comparable to that shown in FIGS. 7 and 8), and here too a reliable attachment of the current bar 4 in the chamber 5 can be ensured via latching between the projection 19 and the recess 20.

FIGS. 7 to 10 show a second embodiment of an electrical connection terminal 1 which differs from the embodiment shown in FIGS. 3 to 6 especially by the current bar 4 being made somewhat differently. Moreover, the connection terminal 1 shown in FIGS. 7 to 10 has a mounting sequence which is somewhat different from the one which was described above. On the other hand, there are no differences in either the clamping springs 3, 3' used or the spring receivers 10 used.

Figure 7:
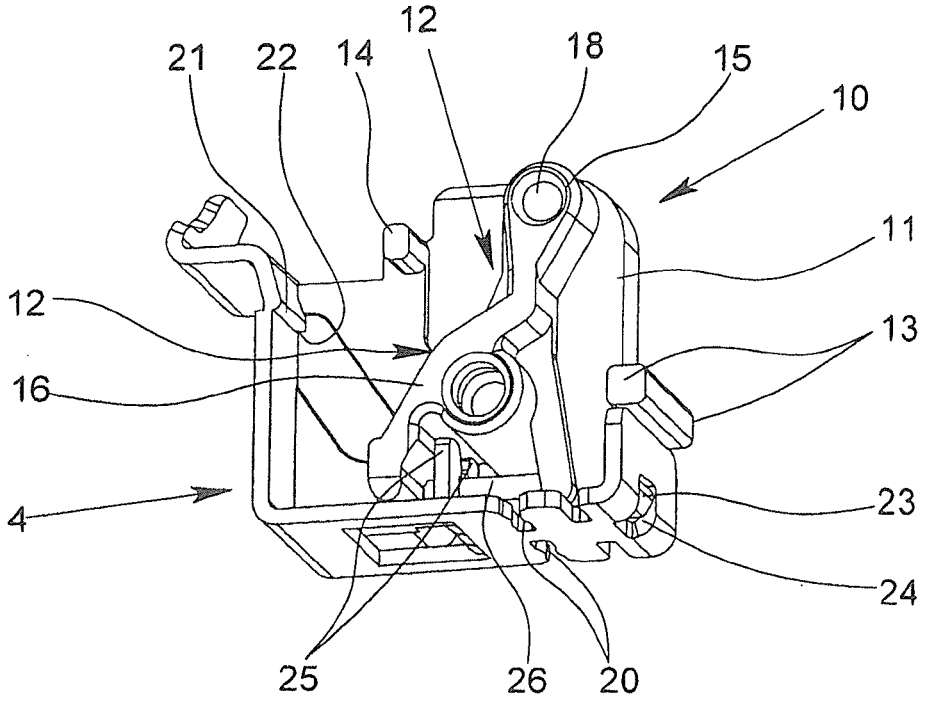
FIG. 7 is a perspective view of the spring receiver according to FIG. 2, locked on a current bar.
Figure 8:
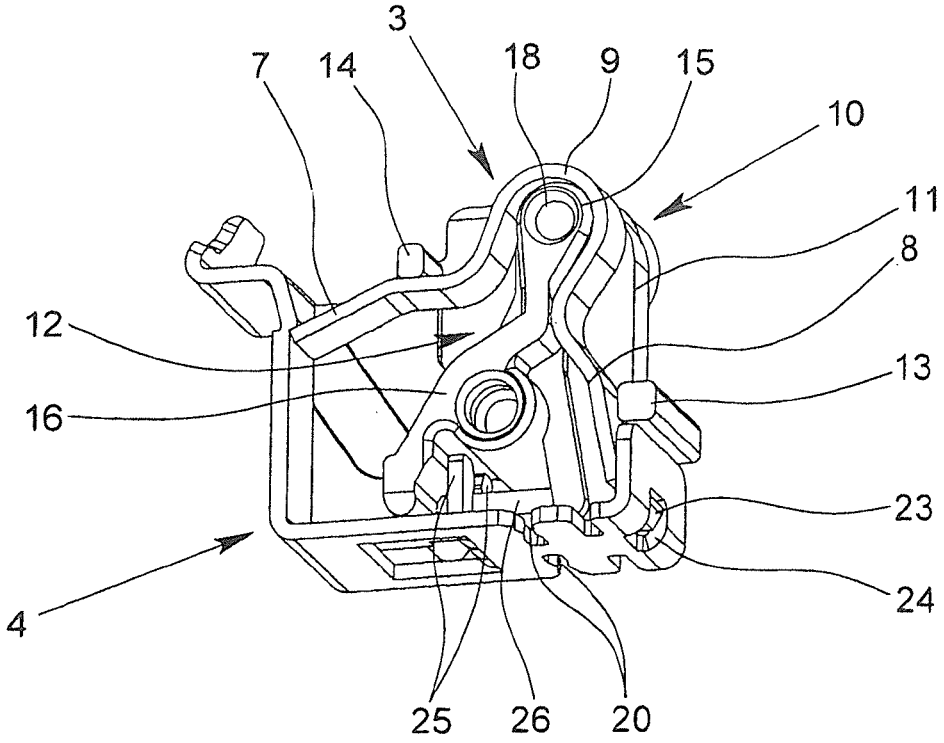
FIG. 8 is a perspective view of the spring receiver locked on the current bar according to FIG. 7, with additionally mounted clamping springs.

In this type of mounting, first a spring receiver 10 according to FIG. 2 is slipped onto the current bar 4 (FIG. 7). For attachment, several catch devices which correspond to one another are made on the current bar 4 and on the spring receiver 10. For this purpose, on the current bar 4 a catch projection 21 and a catch recess 24 are made which interact with a corresponding catch recess 22 and a catch projection 23 respectively on one face side of the spring receiver 10. Moreover, the current bar 4 still has a fork-shaped catch element 25 which is bent vertically and which encompasses a bridge 26 which is made on the spring receiver 10 in the mounted state. The catch devices are all made and arranged such that they hinder neither insertion of the spring receiver 10 without the current bar 4 (FIG. 5) nor insertion of the spring receiver 10 with the current bar 4 (FIG. 9) into the chamber 5 in the housing 2.

Figure 9:
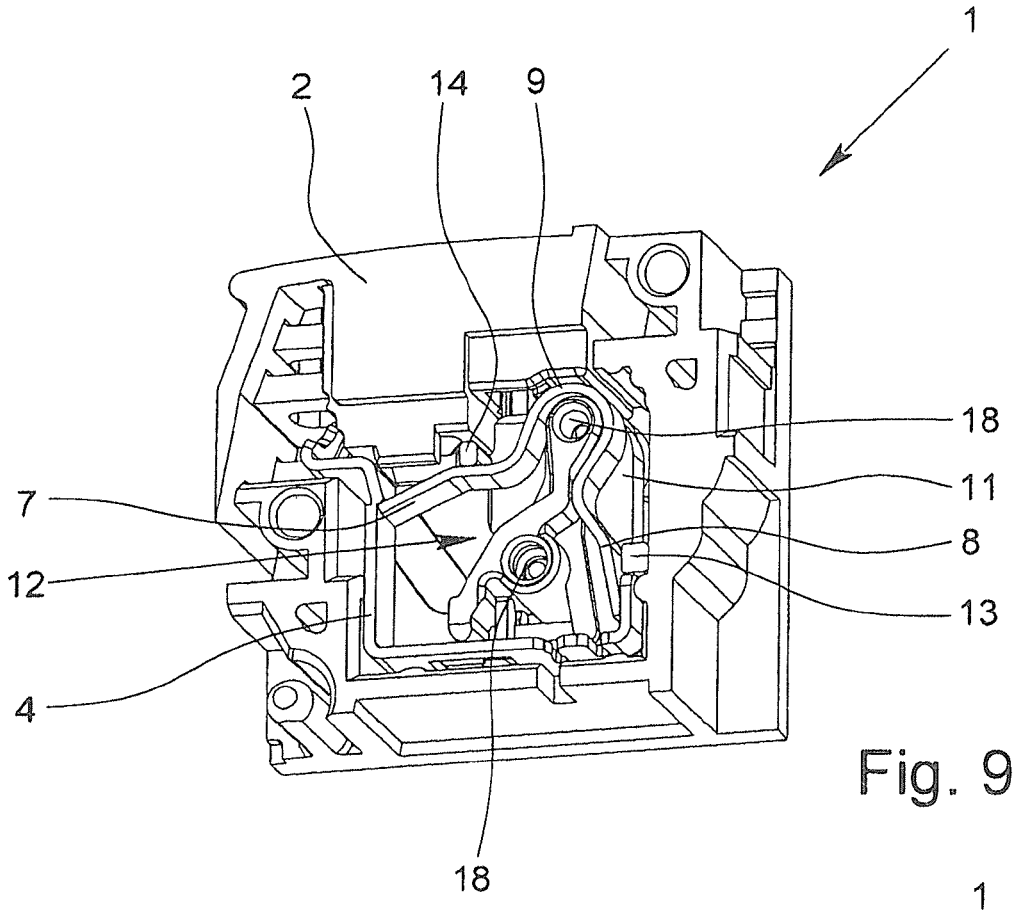
FIG. 9 is a perspective view of the mounting unit composed of the spring receiver, current bar and clamping springs according to FIG. 8, inserted into the chamber of a housing
Figure 10:
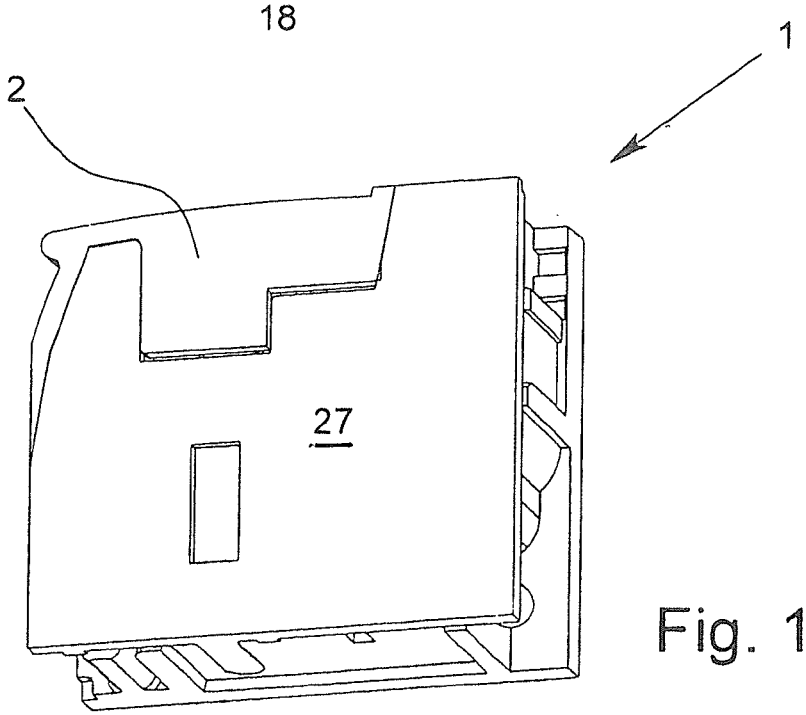
FIG. 10 is a perspective view of the housing according to FIG. 9, closed with a cover.

After slipping and latching the spring receiver 10 on the current bar 4, next the two clamping springs 3, 3' are slipped onto the spring receiver 10. As is apparent from FIG. 8, the clamping springs 3, 3' are held in their position both by the projections 12, 14 which are made on the spring receiver 10 and also by the current bar 4. But alternatively, it is also possible for the clamping springs 3, 3' to be held only or essentially only by the current bar 4, and optionally, still by the projection 12. Then, the assembly formed of the clamping springs 3, 3', the current bar 4 and the spring receiver 10 is inserted into the chamber 5 of the housing 2, where the openings 18 of the spring receiver 10 are slipped onto the catch pegs 17 in the chamber 5 (FIG. 9). Finally, the housing 2 or of the chamber 5 is optionally closed using a cover 27 (FIG. 10).

In the terminal block 1 which is shown in FIG. 1, there is no closure of the chambers 5 by means of a cover or a separate side wall, but it is fundamentally also possible to do so. A closure of the chambers 5 in this embodiment is therefore not necessary since two side walls 28, 29 are bent away from the current bar 4 such that they are used as a boundary for the conductor end which is to be connected so that an inserted conductor cannot be pressed laterally out of the clamping site by the clamping leg 7. Moreover, it is apparent from FIGS. 1 and 2, viewed together, that the spring receiver 10 is made symmetrical to the middle plane, i.e., to the partition 11 so that the same spring receiver 10 can be mounted on both connection sides of the terminal block 1.

Figure 6:
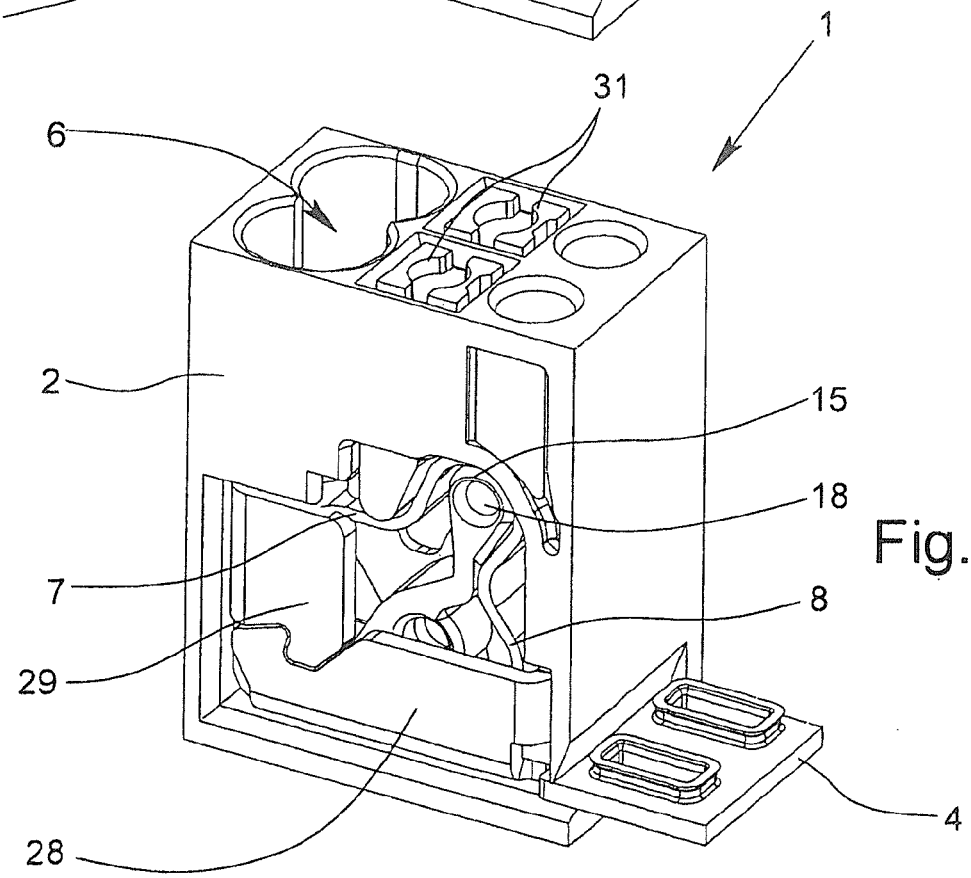
FIG. 6 is a perspective view of the housing according to FIGS. 4 and 5, with a current bar which has also been inserted into the chamber.

In the exemplary embodiment of the electrical connection terminal 1 shown in FIG. 1, in the housing 2, in addition to the conductor entry openings 6 on each of the two connection sides, two actuating openings 30 at a time are formed in which there is an operating pusher 31 (compare FIGS. 5 & 6). In the first, upper position of the operating pusher 31 shown in FIGS. 1 and 6, the clamping site between the assigned clamping leg 7 and the current bar 4 is closed. If an operating pusher 31 is pressed down, for example, using a screwdriver, the operating pusher 31 with its end facing the clamping leg 7 deflects the clamping leg 7 against the spring force of the clamping spring 3 so that the clamping site is opened. Then a flexible conductor without a wire end ferrule can also be inserted into the clamping site or a clamped conductor can be pulled out of the clamping site.

What is claimed is:

1. An electrical connection terminal, comprising:

two clamping springs, at least one current bar, and a housing being provided with a chamber for accommodating at least one end of the at least one current bar and the clamping springs next to one another relative to the longitudinal extension of the current bar and the housing being provided with at least one conductor entry opening for insertion of two conductors, wherein each of the clamping springs has a clamping leg, a contact leg and an arc-shaped back which connects the clamping leg and the contact leg to one another, wherein a clamping site for a stripped conductor which is to be connected is formed by the clamping leg of each clamping spring in conjunction with the current bar, and wherein there is a spring receiver which has a partition within the chamber, each of the two clamping springs being located on a respective side of the partition.

2. The electrical connection terminal as claimed in claim 1, wherein the spring receiver has several projections on each side of the partition which hold the clamping springs.

3. The electrical connection terminal as claimed in claim 2, wherein there is a projection between the legs of the clamping spring and two projections outside of the legs of the clamping springs on each side of the partition, the projection located between the legs of each clamping spring forming a stop for the respective clamping leg when the clamping leg is deflected and has an end which is located in a region of the arc-shaped back of the respective clamping spring.

4. The electrical connection terminal as claimed in claim 1, wherein co-acting catch elements of a catch device are provided in the chamber and on the spring receiver in the region between the legs of the clamping springs with which the spring receiver is latched in the chamber of the housing.

5. The electrical connection terminal as claimed in claim 4, wherein two catch pegs are provided within the chamber and two openings which correspond to the catch pegs are provided in the spring receiver so that the openings of the spring receiver are able to be slipped onto the catch pegs in the chamber.

6. The electrical connection terminal as claimed in claim 1, wherein at least one catch element is located within the chamber of the housing and wherein a corresponding catch recess is provided in the current bar so that the current bar is able to be latched in the housing.

7. The electrical connection terminal as claimed in claim 1, wherein the current bar and the spring receiver are latchable to one another by corresponding catch elements on the current bar and on the spring receiver.

8. The electrical connection terminal as claimed in claim 1, wherein two actuating openings are provided in the housing in each of which an operating pusher is arranged such that the operating pusher can be moved out of a first position in which a respective clamping site is closed into a second position in which an end of the operating pusher deflects the clamping leg of a respective clamping spring against its spring force so that the respective clamping site is opened.

9. A method for mounting of an electrical connection terminal which has a housing, two clamping springs and at least one current bar, wherein a chamber is arranged in the housing for accommodation of the clamping springs and of at least one end of the at least one current bar and wherein at least one conductor entry opening for entry of two conductors is arranged in the housing, comprising the following steps:

arranging the two clamping springs, each of which has one clamping leg, a contact leg and an arc-shaped back which connects the clamping leg and the contact leg to one another, on a spring receiver, which has a partition, each of the clamping springs being located on a respective side of the partition with projections on the receiver being used to hold the clamping springs, inserting the spring receiver with the clamping springs attached to it into the chamber of the housing, and inserting the current bar into the chamber of the housing in a manner forming a clamping site for a stripped conductor which is to be connected together with the clamping leg of each of the clamping springs.

10. The method as claimed in claim 9, wherein the step of inserting the spring receiver with the clamping springs attached to it into the chamber comprises slipping two openings of the spring receiver onto corresponding catch pegs in the chamber so as to latch the spring receiver in the housing.

11. The method as claimed in claim 9, wherein the step of inserting the current bar into the chamber of the housing comprises latching at least one catch element in the chamber with a corresponding catch recess in the current bar.

12. The method as claimed in claim 9, comprising the further step of closing the chamber with a cover after the spring receiver and the current bar have been inserted into the chamber of the housing.

13. A method for mounting of an electrical connection terminal which has a housing, two clamping springs and at least one current bar, wherein a chamber is arranged in the housing for accommodation of the clamping springs and of at least one end of the at least one current bar and wherein at least one conductor entry opening for entry of two conductors is arranged in the housing, comprising the following steps:

slipping of a spring receiver which has one partition onto the current bar so as to engage coacting catch elements on the current bar and on the spring receiver, arranging each of the clamping springs, each of which has a clamping leg, a contact leg and an arc-shaped back which connects the clamping leg and the contact leg to one another, on several projections at a respective side of the partition of the spring receiver in a manner that the clamping leg of each clamping spring forming a respective clamping site for a stripped conductor which is to be connected together with the current bar, inserting the spring receiver with the two clamping springs attached to it and the at least one current bar into the chamber of the housing.

14. The method as claimed in claim 13, wherein the step of inserting the spring receiver with the clamping springs attached to it into the chamber comprises slipping two openings of the spring receiver onto corresponding catch pegs in the chamber so as to latch the spring receiver in the housing.

15. The method as claimed in claim 13, wherein the step of inserting the current bar into the chamber of the housing comprises latching at least one catch element in the chamber with a corresponding catch recess in the current bar.

16. The method as claimed in claim 13, comprising the further step of closing the chamber with a cover after the spring receiver and the current bar have been inserted into the chamber of the housing.

* * * * *